United States Patent [19]

Bosich

[11] Patent Number: 4,793,729

[45] Date of Patent: Dec. 27, 1988

[54] PROCESS OF MAKING MATERIAL FOR AND CONSTRUCTING A ROAD

[76] Inventor: Joseph F. Bosich, 9405 Brakeman Rd., Chardon, Ohio 44024

[21] Appl. No.: 142,508

[22] Filed: Jan. 7, 1988

Related U.S. Application Data

[63] Continuation-in-part of Ser. No. 776,211, Sep. 16, 1985, Pat. No. 4,668,121, and a continuation-in-part of Ser. No. 908,617, Sep. 17, 1986, abandoned.

[51] Int. Cl.[4] ..... E01C 7/00; C08L 95/00

[52] U.S. Cl. ..... 404/72; 106/281.1; 106/409

[58] Field of Search ..... 404/17, 72, 71, 75, 404/32; 106/281 R, 288 B, 273 R; 427/138; 428/489; 166/901

[56] References Cited

U.S. PATENT DOCUMENTS

| | | | |
|---|---|---|---|
| 2,313,199 | 3/1943 | Heyning | 404/75 |
| 2,667,425 | 1/1954 | Bierly et al. | 106/281 R |
| 3,791,443 | 2/1974 | Burt et al. | 166/901 |
| 3,818,711 | 6/1974 | Condo et al. | 404/72 |
| 3,909,474 | 9/1975 | Borchert et al. | 404/17 |
| 3,986,781 | 10/1976 | Condo et al. | 166/901 |
| 4,364,773 | 12/1982 | Veronneau et al. | 106/281 R |

*Primary Examiner*—Stephen J. Novosad
*Assistant Examiner*—Bruce M. Kisliuk
*Attorney, Agent, or Firm*—Tarolli, Sundheim & Covell

[57] ABSTRACT

A process of making materials for road construction and other purposes includes separating water from oil well drilling mud or other waste material sludge to form a partially dried sludge. The partially dried sludge is subjected to heat to further dry the sludge. The dried sludge is combined with an open cell aggregate or sand and caustic soda in a pug mill and ground to form relatively small particles. The small particles are expanded to a size which is at least 2 to 10 times the original size of the particles. When a road is to be built, the expanded particles are mixed with asphalt to form a product. This product has a thermal conductivity of approximately 0.36 B.t.u./(hr.)(sq.ft.) (deg.F./ft.). The product is then deposited over frozen and/or unfrozen ground during the construction of a road.

12 Claims, 5 Drawing Sheets

PROCESS OF MAKING MATERIAL FOR AND CONSTRUCTING A ROAD

BACKGROUND OF THE INVENTION

Under the provisions of Title 35 of U.S. Code, Paragraph 120, is application is a continuation-in-part of U.S. application Ser. No. 776,211 filed Sept. 16, 1985 and issued as U.S. Pat. No. 4,668,121 on May 26, 1987. In addition, under the provisions of Title 35 of U.S. Code, Paragraph 120, this application is a continuation-in-part of U.S. patent application Ser. No. 908,617 filed Sept. 17, 1986, now abandoned.

The present invention relates to a new and improved method of forming an improved product for use in making a road which extends over frozen ground and for use in making other products, such as lightweight insulation, gravel substitutes, insulating coatings for pipelines, and oil absorbents.

In artic and subartic retions, permafrost underlies the surface of land areas where roads are to be built. In order to prevent thawing of the permafrost and the attendant instability, five foot or thicker layers of gravel have been provided to insulate the permafrost. Since the use of relatively large amounts of gravel is both costly and, in certain instances, detrimental to the environment from which the gravel is obtained, it has been suggested that styrene boards be used to reduce the amount of gravel required to insulate a road from the permafrost.

During oil well drilling operations, drilling muds are a waste product. Due to the materials commonly found in drilling muds, disposing of oil well drilling mud without damaging the environment has presented difficulties.

BRIEF SUMMARY OF THE INVENTION

The present invention provides a method of using oil well drilling mud and/or other waste sludges to form a useful product which has a relatively low thermal conductivity. The product may advantageously be used in the construction of roads, in the making of insulation, in the making of lightweight concrete, as an oil absorbent, and in other ways. The low thermal conductivity of the product enables a relatively small thickness of the product to be used as an insulation barrier to protect the permafrost when a road is to be built in an artic or subartic region. The product could also be used in the building of roads in relatively warm environments. The product can also be used for purposes other than building roads, for example, as oil well drilling pads, airport runways, insulation in buildings, as an oil absorbent, or as a gravel substitute.

The product is formed by taking oil well drilling mud or other waste sludges and separating the water from the waste sludge. The partially dried sludge is then subjected to heat to further dry the sludge. The dried sludge is combined with an open cell aggregate and/or caustic soda to form a product. The product may be heated, ground and expanded by 2 to 10 times to form an expanded product. The expanded product has a thermal conductivity between 0.30 and 0.50 B.t.u./(hr.)(sq.ft.)(deg.F./ft.) so that a relatively small thickness of the expanded product provides an effective insulation barrier. The expanded product may then be used by being mixed with asphalt and deposited over frozen ground to form a road. The expanded product may also be used for insulation, fireproofing, as a gravel substitute, as an oil absorbent, or as a building material.

Accordingly, it is an object of this invention to provide a new an improved process of making material for and constructing a road over frozen ground wherein the material is made from waste sludge and has a relatively low thermal conductivity.

Another object of this invention is to make a lightweight material, which is suitable for any one of many different uses, by separating water from a waste material sludge, forming a solid body of material by heating a mixture containing the partially dried sludge, grinding the solid body of material to form particles of a first size, and expanding the particles to a second size which is at least 2 to 10 times the first size.

BRIEF DESCRIPTION OF THE DRAWINGS

The foregoing and other objects and features of the present invention will become more apparent upon a consideration of the following description taken in connection with the accompanying drawings wherein.

DESCRIPTION OF ONE SPECIFIC PREFERRED EMBODIMENT OF THE INVENTION

Figure 1:
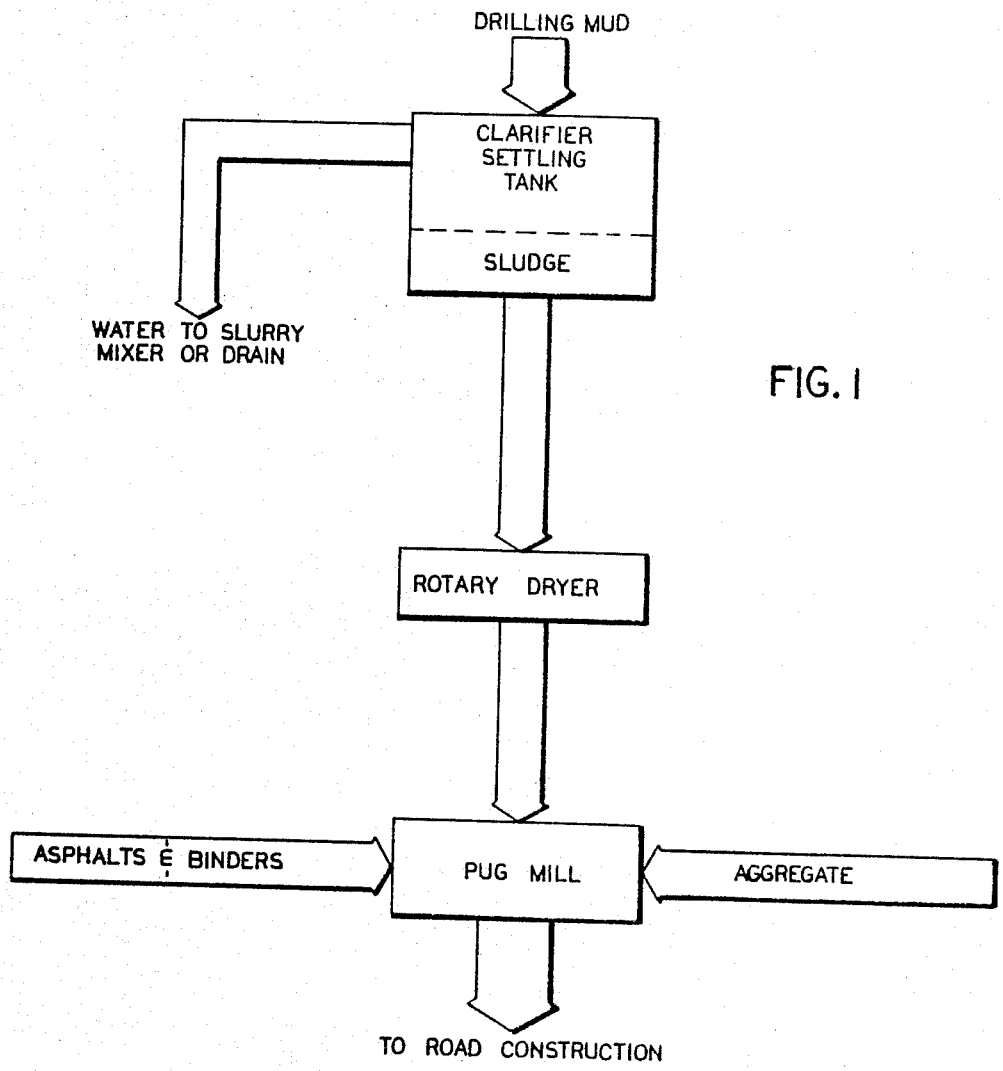
FIG. 1 chart schematically depicting the manner in which an improved product of the present invention is formed and used in the building of a road.

An improved road construction product is formed from oil well drilling muds or other waste sludges. In forming the product, the oil well drilling muds are deposited in a settling tank 10 (FIG. 1). Excess water is separated from the drilling mud. The excess water is conducted to a mixer to form a slurry used in other processes or to drain. The partially dried sludge is then conducted to a rotary dryer 12 where any brines, chromates or other toxic organic chemicals are decomposed by subjecting the sludge to heat as it is agitated in the rotary dryer. When toxic materials are contained in the sludge, a polybutidiene polymer may be added to the sludge. The dried sludge which is removed from the rotary drier has a rubbery consistency. The dried sludge is expanded and conducted to a pug mill 14.

Asphalt binders are added to the dried sludge in the pug mill 14. In addition, a lightweight open cell aggregate is also added to the partially dried sludge in the pug mill. One suitable open cell lightweight aggregate is "Dacotherm" (trademark) sold by Diamond Shamrock Corporation. In addition to the open cell lightweight aggregate, a lightweight clay or sand aggregate is added to the material in the pug mill. The pug mill 14 is then operated to intermix these materials to form a road construction product. During operation of the pug mill, the aggregate is kept at a temperature between 200° and 400° F.

As a result of operating the pug mill, a lightweight road construction product is formed. This product has a thermal conductivity between 0.30 and 0.50 B.t.u/(hr.)(sq.ft.) (deg.F./ft.). The average thermal conductivity will be approximately 0.36 B.t.u./(hr.)(sq.ft.)-(deg.F./ft.). The relatively low thermal conductivity of the product makes it particularly well suited for use in applications where an insulating barrier is desired. The compressed unit weight of the product is about 20 to 35 lbs. per cubic foot. The compressive strength of the product is in excess of 200 lbs. per square inch. The freeze-thaw resistance of the product is in excess of 50 cycles.

Figure 2:
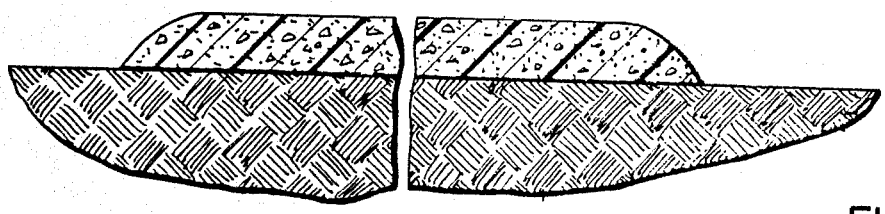
FIG. 2 is a schematic illustration depicting the manner in which the improved product is deposited over ground to form a road.

Due to the relatively low cost of forming the product and the relatively low thermal conductivity of the product, the product is particularly well suited for use in road construction. Thus, when a road is formed in the manner illustrated schematically in FIG. 2, the product is deposited in a layer 18 over a bed on frozen ground 20 to form a road. Since the product has a relatively low coefficient of thermal conductivity, the layer 18 can be relatively thin. In the past, at least five feet of gravel has been used to insulate a road from the permafrost in the ground 20. When an improved product formed in accordance with the present invention is used to form the layer 1, the layer need only have a thickness of approximately 6 inches. Of course, the specific thickness of the layer 18 will vary depending upon the environment in which the layer is to be used and the operating conditions to which it is to be subjected. Thus, the product could be used in relatively warm climates to form roads over ground which is not frozen or even particularly cold.

Figure 3:
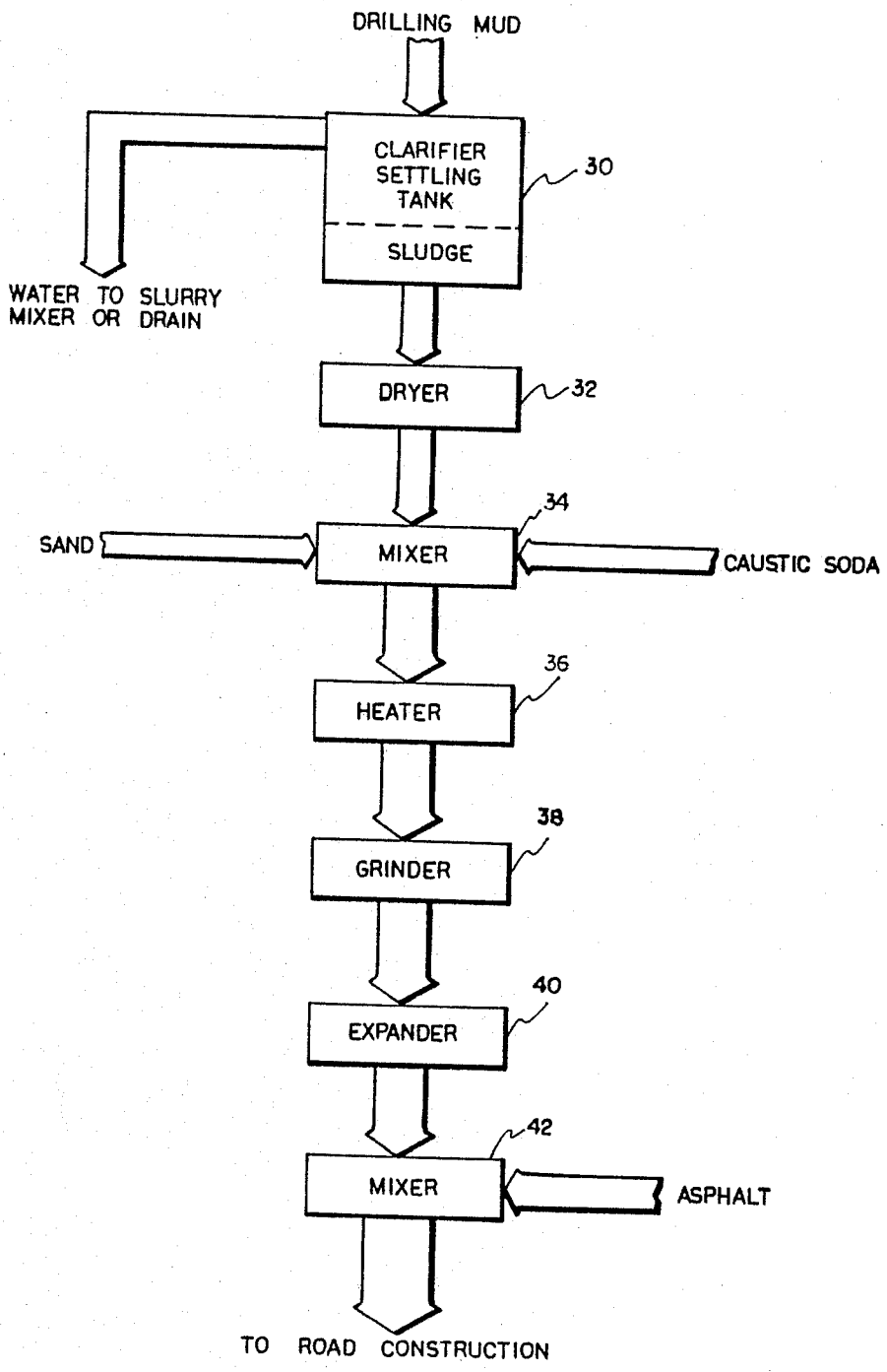
FIG. 3 is a flow chart schematically depicting another manner in which the improved product of the present invention is formed.

An improved road construction product can also be formed from drilling muds or other waste sludges in the manner illustrated schematically in FIG. 3. In forming the product, oil well drilling muds are deposited in a settling tank 30. Excess water is separated from the drilling mud. The excess water is conducted to a mixer for a slurry used in other processes or to drain. If desired, a centrifuge may be used to separate the excess water from the mud.

The partially dried sludge is then conducted to a rotary dryer 32 where any brines, chromates or other toxic organic chemicals are decomposed by subjecting the sludge to heat as it is agitated in the dryer. When toxic materials are contained in the sludge, a polybutidiene polymer may be added to the sludge. The dried sludge which is removed from the rotary dryer is transferred to a mixer 34.

In accordance with a feature of this embodiment of the invention, hot caustic soda, that is, sodium hydroxide or potassium hydroxide, is added to the dried sludge in the mixer 34. In addition, clays, sand, silicates, and other inorganic chemicals may also be added to the product. The caustic soda has a water base. Additional water may be added to promote the mixing action.

The resulting mixture from the mixer 34 is transferred to a heater 36 and heated to 210° to 400° F. An exothermic action occurs and water is driven of from the material in the heater. The result is a hard lump of material. This material includes the dried sludge, sand, clays, and caustic soda.

The relatively hard lump of material is transferred from the heater 36 to a grinder 38. The grinder 38 grinds the material to have a particle size of from 20 mesh to approximately a quarter of an inch. The particles are transferred from the grinder 38 to a rotary screen (not shown) and then to an expander 40.

The expander 40 increases the size of the particles transferred from the grinder by two to ten times. By expanding the particles, they become very lightweight and have a relatively low coefficient of thermal conductivity. Thus, the expander 40 increases the particle size to one-half inch and larger. The resulting expanded particles have an average thermal conductivity which will be less than approximately 0.36 B.t.u./(hr.)(sq.ft.) (deg.F./ft.). Due to the lightweight and relatively low thermal conductivity the product from the expander 40, it is particularly well suited for use in applications where an insulation barrier is desired. Thus, the weight of the product from the expanded 40 is approximately 2 to 20 lbs./cu.ft.

Due to the relatively low cost of forming the product from the expander 40 and the relatively low thermal conductivity of the product, it is particularly well suited for use in road construction. When a road is to be formed in the manner illustrated schematically in FIG. 2, the product from the expander 40 is transferred to a mixer 42 and mixed with asphalt at temperatures of 200° to 350° F. In the mixer 42 the expanded particles from the expander 40 are completely covered with asphalt. This results i a road forming material having very low thermal conductivity and high resistance to severe cold weather environment. The asphalt coated expanded particles are used to form the layer 18 (FIG. 2) of a road. The layer of asphalt coated expanded particles may be placed over either frozen or unfrozen ground. When used over frozen ground, the low thermal conductivity of the asphalt coated expanded particles protect the frozen ground.

Figure 4:
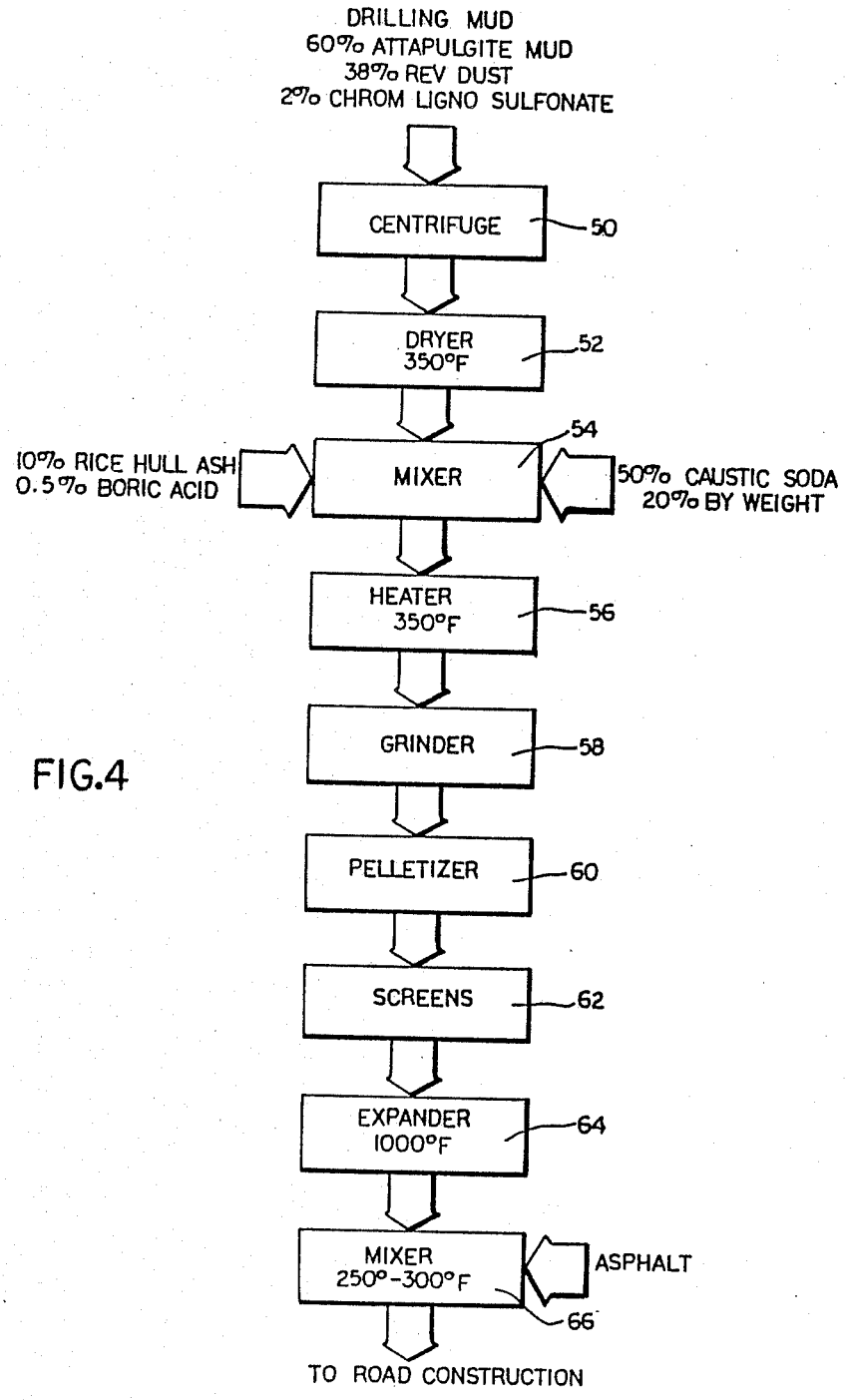
FIG. 4 is a flow chart schematically illustrating the manner in which an attapulgite drilling mud is used to form one specific embodiment of the improved product of the present invention.

In one specific example, the improved road construction product is formed from a drilling mud containing 60 percent (by weight) attapulgite mud, 38 percent (by weight) rev dust (sand, clay, sodium chloride, etc.), and 2 percent (by weight) chromium lignosulfonate. In forming the product, the attapulgite drilling mud is deposited in a centrifuge 50 (FIG. 4). Excess water is separated from the attapulgite drilling mud. The partially dried sludge is then conducted to a rotary dryer 52 where the sludge is heated to approximately 350° F. The dried sludge is removed from the rotary dryer 52 and is transferred to a mixer 54.

Rice hull ash, in a quantity of 10 percent by weight, is added to the dried attapulgite mud in the mixer 54. In addition, 0.5 percent (by weight) boric acid and hot caustic soda, that is, sodium hydroxide, is added to the dried attapulgite mud in the mixer 54. The amount of caustic soda is varied, between 30 and 70 percent (by weight). The amount of caustic soda is sufficient to cause the mixture to swell and rise like a dough.

The resulting swollen mixture from the mixer 54 is transferred to a heater 56 and heated to 350° F. An exothermic action occurs and water is driven off from the material in the heater. The result is a hard lump of material. This material includes the dried attapulgite mud and caustic soda.

The relatively hard lump of material is transferred from the heater 56 to a grinder 58. The grinder 38 grinds the material to have a particle size of approximately a quarter of an inch. The particles are transferred from the grinder 58 to a pelletizer 60. The pellets from the pelletizer 60 are screened at 62 to eliminate small particles.

The pellets are then transferred to an expander 64 and heated to approximately 1000° F. The size of the pellets increase in the expander by two to ten times. The expanded pellets have an average thermal conductivity which is less than approximately 0.36 B.t.u./(hr.)(sq.ft.)-(deg.F./ft.). The weight of the expanded pellets from the expander 40 is approximately 20 to 30 lbs./cu.ft. The expanded pellets are transferred from the expander 64 to a mixer 66 and mixed with asphalt. In the mixer 42 the expanded particles from the expander 40 are covered with asphalt and maintained at a temperature of 250°-300° F. This results in a road forming material having very low thermal conductivity and high resistance to severe cold weather environment. However, the expanded pellets from the expander 40 may be used for purposes other than building roads.

Figure 5:
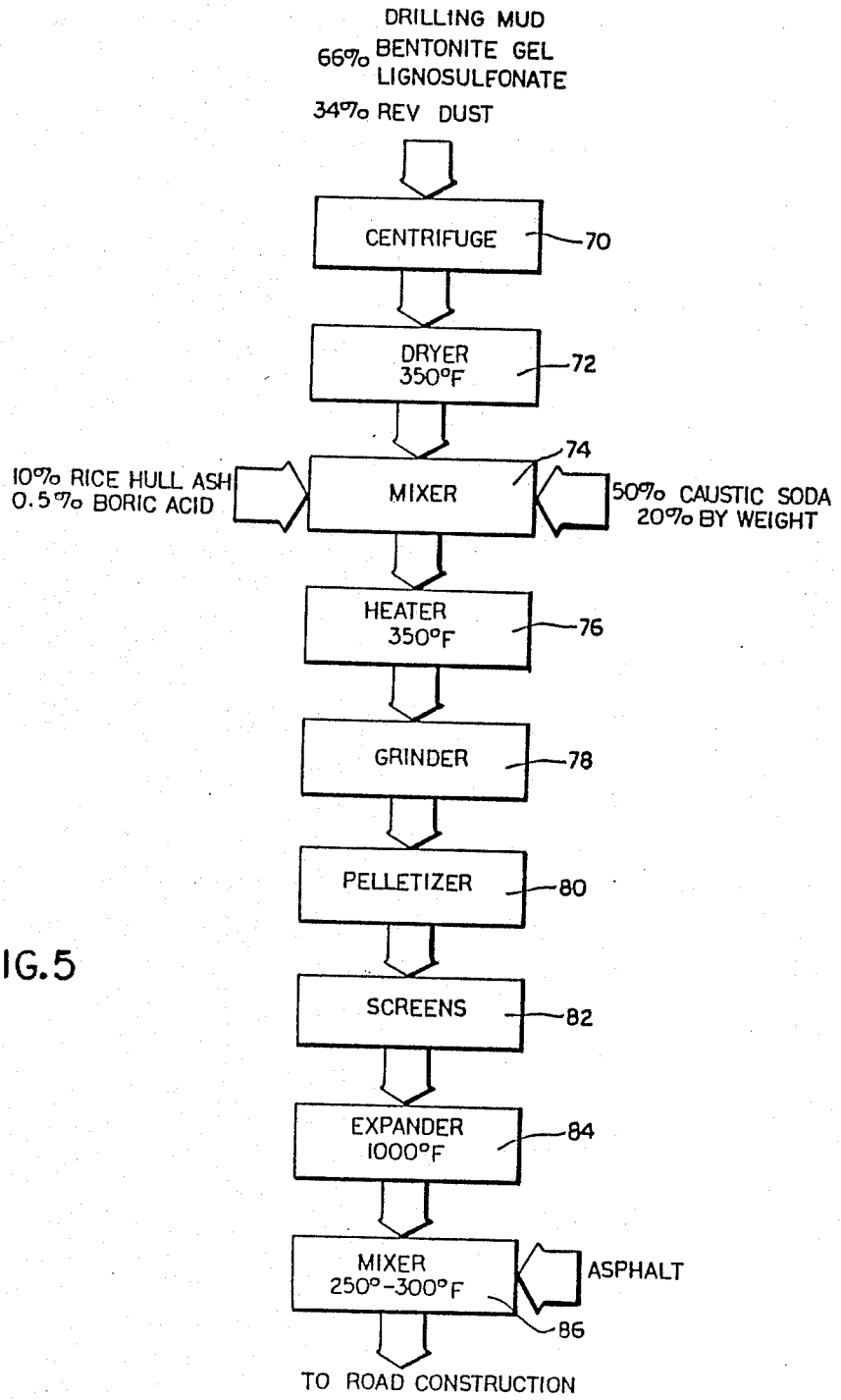
FIG. 5 is a flow chart schematically illustrating the manner in which a bentonite gel drilling mud is used to form another specific embodiment of the improved product of the present invention.

In another specific example, the improved road construction product is formed from a drilling mud containing 66 percent (by weight) bentonite gel and lignosulfonate, and 34 percent (by weight) rev dust (sand, clay, sodium chloride, etc.) In forming the product, the bentonite gel drilling mud is deposited in a centrifuge 70 (FIG. 5). Excess water is separated from the bentonite gel drilling mud. The partially dried sludge is then conducted to a rotary dryer 72 where the sludge is heated to approximately 350° F. The dried sludge is removed from the rotary dryer 72 and is transferred to a mixer 74.

Rice hull ash, in a quantity of 10 percent by weight, is added to the dried bentonite gel mud in the mixer 74. In addition, 0.5 percent (by weight) boric acid and hot caustic soda, that is, sodium hydroxide, is added to the dried attapulgite mud in the mixer 74. The amount of caustic soda is varied between 30 and 70 percent (by weight). The amount of caustic soda is sufficient to cause the mixture to swell and rise like a dough.

The resulting swollen mixture from the mixer 74 is transferred to a heater 76 and heated to 350° F. An exothermic action occurs and water is driven off from the material in the heater. The result is a hard lump of material. This material includes the dried bentonite gel mud and caustic soda.

The relatively hard lump of material is transferred from the heater 56 to a grinder 58. The grinder 38 grinds the material to have a particle size of approximately a quarter of an inch. The particles are transferred from the grinder 78 to a pelletizer 80. The pellets from the pelletizer 80 are screened at 82 to eliminate small particles.

The pellets are then transferred to an expander 84 and heated to approximately 1000° F. The size of the pellets increase in the expander by two to ten times. The expanded pellets have an average thermal conductivity which is less than approximately 0.36 B.t.u./(hr.)(sq.ft.)-(deg.F./ft.). The weight of the expanded pellets from the expander 40 is approximately 20 to 30 lbs./cu.ft. The expanded pellets are transferred from the expander 64 to a mixer 66 and mixed with asphalt. In the mixer 42 the expanded particles from the expander 40 are covered with asphalt and maintained at a temperature of 250°-300° F. This results in a road forming material having very low thermal conductivity and high resistance to severe cold weather environment. The expanded pellets from the expander 40 may be used for purposes other than building roads.

Figure 6:
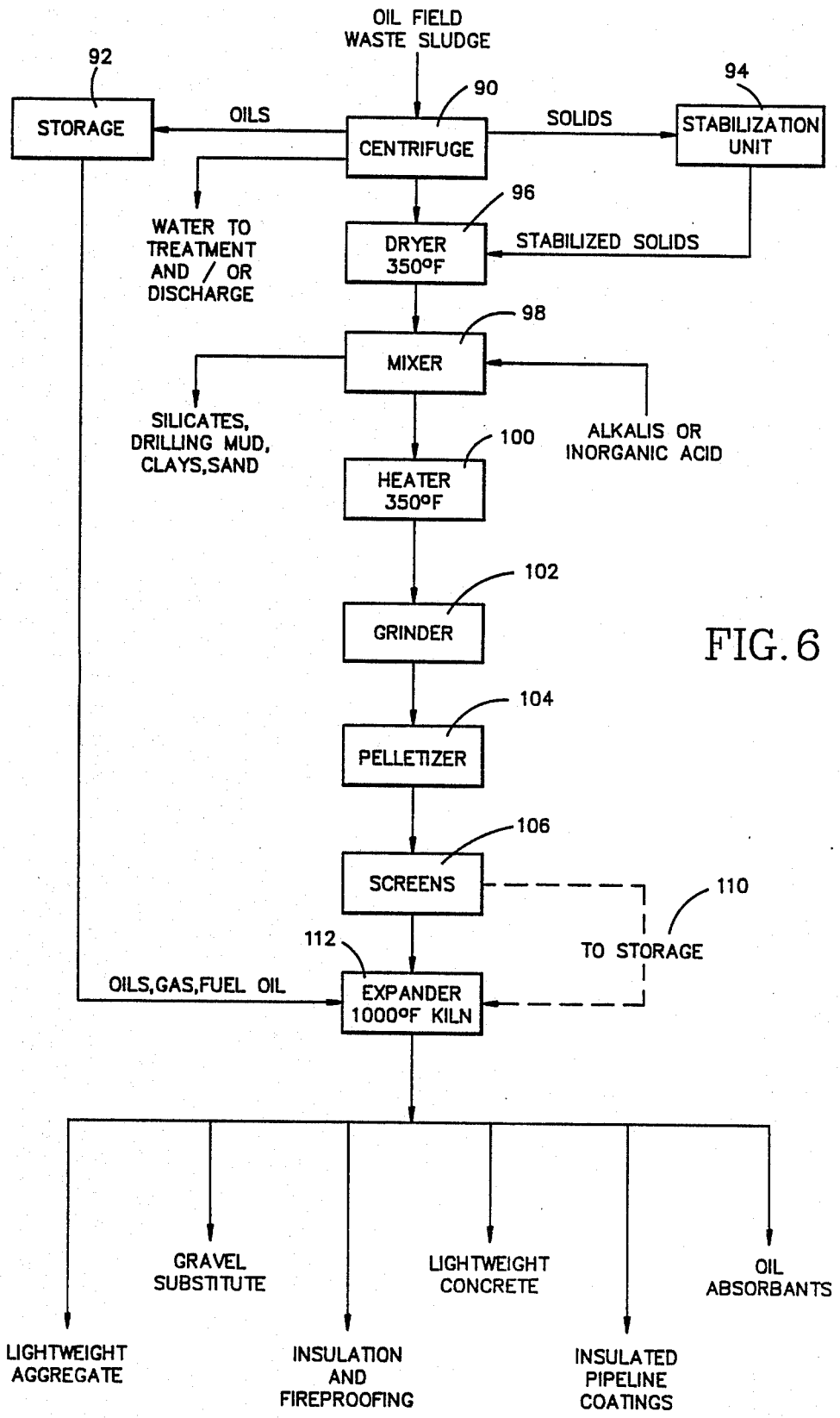
FIG. 6 is a flow chart illustrating the manner in which oil field waste sludge is used to form a lightweight product having many different uses.

FIG. 6 is a schematic illustration depicting the manner in which oil field waste material sludge is used to form a lightweight material which can be used for many different purposes. Thus, in the embodiment of the invention described in conjunction with FIGS. 1 through 5, the lightweight material was used for the forming of a road. As was previously discussed, the insulating characteristics of the lightweight material make it particularly advantageous for use in forming roads over frozen ground. However, a material could be used to form roads over unfrozen ground. However, as is illustrated schematically in FIG. 6, the lightweight material could be used for many different things such as a gravel substitute, a lightweight aggregate, insulation and/or fireproofing, cement to form a lightweight concrete, a polymeric binder to form an insulated pipeline coating, or as an oil absorbent. Thus, it has been determined that the lightweight expanded particles formed by a method generally similar to that illustrated in FIGS. 1-5 can advantageously be used in many different products. This is in part due to the relatively large surface area of the expanded particles, their low thermal conductivity, and their relatively lightweight.

In accordance with the embodiment of the invention illustrated in FIG. 6, oil field waste sludge is conducted to a centrifuge 90. The oil field waste sludge may be a mixture of drilling muds. Other waste products associated with the drilling of oil wells may be included in the sludge.

Excess water is separated from the waste material sludge and is conducted to a water treatment plant and/or discharged to a receiving location. Oils separated from the sludge are transferred to a storage tank 92. The solid material from which the excess water and oils have been separated is transferred to a stabilization unit 94 where the solid material is stabilized by adding polymers.

The stabilized solids from the stabilization unit 94 are transferred to a rotary drier 96 where the solids are heated to a temperature of approximately 350° F. to further dry the solid material. The dried sludge is then removed from the drier 96 and transferred to a mixer 98. Solids, such as rice hull ash, silicates or drilling mud, sand and/or clays are added to the dried sludge in the mixer 98. In addition, alkalis and/or inorganic acid are added to the material in the mixer 98. Thus, 0.5% (by weight) boric acid and/or hot caustic soda, that is, sodium hydroxide, is added to the material in the mixer 98. The amount of caustic soda varies, between 30 percent and 70 percent (by weight). The amount of caustic soda is sufficient to cause the mixture in the mixer 98 to swell and rise like a dough.

The resulting swollen mixture from the mixer 98 is transferred to a heater 100 and heated to approximately 350° F. An exothermic action occurs and water is driven off from the material in the heater. The result is a hard lump of material. This material includes the dried sludge and caustic soda. Although the sludge has been dried, it is believed that there is still a relatively small amount of moisture contained in the dried material.

The relatively hard lump of material is transferred from the heater 100 to a grinder 102. The grinder 102 grinds the material to have a particle size of approximately a quarter of an inch. The particles are transferred from the grinder to a pelletizer 104. Pellets formed in the pelletizer 104 are screened at 106 to eliminate small particles.

The pellets from the screens 106 may be moved to a storage location 110, in the manner indicated by dashed lines in FIG. 6, where the pellets are stored in bags or bins until they are needed. When the pellets are needed, they are transferred either directly from the screen 106 to an expander 112 and/or are transferred from the storage location 110 to the expander 112. Since the pellets have not been expanded they are relatively dense and compact and an be easily stored. The pellets are heated in the expander 112 to a temperature of approximately 1,000° F. The size of the pellets increase in the expander by two to ten times. The expanded pellets have an average thermal conductivity which is less than approximately 0.36 B.t.u./(hr.)(sq.ft.)(deg.F./ft.). The weight of the expanded pellets from the expander 40 is approximately 20 to 30 lbs./cu. ft. Although it is not known for certain, it is believed that the reason that the size of the pellets increases by two to ten times in the expander 112 is that the moisture which remains in the pellets turns to steam and causes the pellets to expand. Regardless of how and why the pellets expand in the expander 112, they are relatively lightweight, have a relatively large surface area, and have a very low thermal conductivity.

Economical operation of the expander 112 is advantageously promoted by using oil from the storage tank 92 to heat the pellets. Thus, oil removed from the waste sludge by the centrifuge 90 is used to heat the pellets in the expander 112. Of course, oil, gas or fuels from other sources could be used in addition to the oil from the storage tank 92 to heat the pellets in the expander 112.

The expanded pellets are transferred from the expander 112 to one or more locations where they are used for any one of man different purposes. The expanded pellets may be used as a gravel substitute in roads and/or building materials. The pellets may be mixed with cement to form a very lightweight concrete which may be cast to form building blocks and/or walls of a building. Due to the low thermal conductivity of the expanded pellets, they are advantageously utilized as an insulating material in a building or other location. It is believed that the insulating characteristics of the expanded pellets will lend themselves to being used as a covering for pipelines in relatively cold climates. The expanded pellets do not burn under normal conditions and therefore can be used as fireproofing as well as insulation. Since the expanded pellets have a relatively large surface area, they can be used as an oil absorbent.

The expander 112 may be portable so that it can be move to various locations where expanded pellets are necessary. Thus, the relatively small compact pellets from the storage 110 will be transferred to an expander 112 at a location where expanded pellets are to be used. At the location where the pellets are to be used, they would be expanded by heating them to a temperature of approximately 1,000° F. in the expander. The pellets expand to a size which is at least 2 to 10 times as great as their original size. Expanded pellets would then be removed from the expander and used in the desired manner.

It is believed that this method of proceeding will be particularly advantageous when roads are to b built over frozen and/or unfrozen ground in remote or relatively inexcessible locations. Thus, the expander would be transported to the remote area where the road is to be built. The relatively compact and small particles will be transferred from a storage location to the expander. The small particles will then be expanded by at least two to ten times their original size. The particles could then be mixed with asphalt and deposited over the ground in the remote location to form a road.

In view of the foregoing description, it is apparent that the present invention provides a method of using drilling mud and/or other waste sludges to form a product which is suitable for many different purposes and which has a relatively low thermal conductivity. The low thermal conductivity of the product enables it to be used as an insulation barrier to protect the permafrost when a road is to be built in an artic or subartic region. Of course, the product could be used for other purposes than building roads.

The product is formed by taking oil well drilling mud and/or other waste sludges and separating the water from the waste sludge in a clarifier settling tank 10. The partially dried sludge is then subjected to heat in a rotary dryer 12 to further dry the sludge. The dried sludge is combined with an open cell aggregate in a pug mill to form a product. The open cell aggregate retains any oils in the product. The product has a thermal conductivity of approximately 0.36 B.t.u./(hr.)(sq.ft)) (deg.F./ft.). Therefore, the product can be mixed with asphalt and a relatively small thickness of the product deposited in a layer 88 over frozen ground 20 to form a road. The product can also be used as insulation, fireproofing, an oil absorbent, and as a building material.

The product may also be formed by taking oil well drilling mud or other waste sludges and separating the water from the waste sludge in a clarifier settling tank 30. The partially dried sludge is then subjected to heat in dryer 32. The dried sludge is mixed with hot water base caustic soda and sand in a mixer 34. The resulting mixture is heated in a heater 36 to form a hard lump of material. This hard lump of material is ground in grinder 38 to have a relatively small particle size. The size of the particles is greatly increased in an expander 40. The relatively small particles are readily stored and then transported to an expander. The expanded particles are then used in any desired manner. The expanded particles may be mixed with asphalt in a mixer 42. The asphalt coated particles are then deposited in a layer 18 to form a road. The insulating characteristics of the expanded particles are particularly advantageous when the layer is deposited over frozen ground 20 to form a road.

Having described specific preferred embodiments of the invention, the following is claimed:

1. A process of making materials for and constructing a road over frozen ground, said process comprising separating water from waste material sludge to form a partially dried sludge, mixing the partially dried with caustic soda, forming a solid body of material by heating the mixture of sludge and caustic soda, grinding the body of material to form particles of a first size, the particles to a second size which is at least 2 to 10 times as great as the first size, mixing the particles of a size with asphalt to form a product, and depositing the over frozen ground to at least partially form a road.

2. A process as set forth in claim 1 wherein said product has a thermal conductivity between 0.30 to 0.50 B.t.u./(hr.) (sq.ft.)(deg.F./ft.).

3. A process as set in claim 2 wherein the waste material sludge is a drilling mud obtained from an oil well drilling operation.

4. A process as set forth in claim 2 wherein said product has a weight of approximately 20 to 35 lbs./cu.ft.

5. A process as set in claim 2 wherein the product has a compressive strength at least 200 p.s.i.

6. A process as set in claim 1 further including mixing silicon dioxide with the sludge and caustic soda prior to performing said step of forming a solid body of material.

7. A process of making lightweight material from waste material sludge said process comprising separating water from the waste material sludge to form a partially dried sludge, mixing the partially dried sludge with caustic soda, forming a solid body of material by heating the mixture of sludge and caustic soda, grinding the solid body of material to form particles of a first size, and expanding the particles to a second size which is at least 2 to 10 times as great as the first size.

8. A process as set forth in claim 7 wherein said particles of a second size have an average thermal conductivity of less than 0.36 B.t.u./(hr.) (sq.ft.)(deg.F./ft.).

9. A process as set forth in claim 7 wherein the waste material sludge is a drilling mud obtained from an oil well drilling operation.

10. A process as set forth in claim 7 wherein said product has a weight of approximately 2 to 20 lbs./cu.ft.

11. A process as set forth in claim 7 further including the step of mixing the particles of a second size with cement for form a lightweight concrete.

12. A process as set forth in claim 7 wherein the waste material sludge is a drilling mud, said step of separating water from the waste material sludge includes the step of removing oil from the waste material sludge, said step of expanding the particles to a second size which is at least 2 to 10 times the first size includes heating the particles of a first size, said step of heating the particles of a first size includes burning oil removed from the waste material sludge.

* * * * *

UNITED STATES PATENT AND TRADEMARK OFFICE

CERTIFICATE OF CORRECTION

PATENT NO. : 4,793,729

DATED : December 27, 1988

INVENTOR(S) : Joseph F. Bosich

It is certified that error appears in the above-identified patent and that said Letters Patent is hereby corrected as shown below:

Column 8, line 56, after "size," insert --expanding --.

Column 8, line 58, after "a" insert --second --.

Column 8, line 59, after "the" insert -- product --.

Signed and Sealed this

First Day of August, 1989

*Attest:*

*Attesting Officer*

DONALD J. QUIGG

*Commissioner of Patents and Trademarks*